US009097051B2

(12) United States Patent
Hellwig

(10) Patent No.: US 9,097,051 B2
(45) Date of Patent: Aug. 4, 2015

(54) DOOR OPERATOR

(71) Applicant: Alexander Hellwig, Ennepetal (DE)

(72) Inventor: Alexander Hellwig, Ennepetal (DE)

(73) Assignee: Dorma Deutschland GmbH, Ennepetal (DE)

( * ) Notice: Subject to any disclaimer, the term of this patent is extended or adjusted under 35 U.S.C. 154(b) by 0 days.

(21) Appl. No.: 14/087,948

(22) Filed: Nov. 22, 2013

(65) Prior Publication Data

US 2014/0157544 A1 Jun. 12, 2014

(30) Foreign Application Priority Data

Nov. 28, 2012 (DE) ..... 10 2012 111 539

(51) Int. Cl.

*E05F 3/22* (2006.01)
*E05F 3/10* (2006.01)
*E05F 1/08* (2006.01)

(52) U.S. Cl.

CPC . *E05F 3/227* (2013.01); *E05F 1/08* (2013.01); *E05F 3/10* (2013.01); *E05F 3/102* (2013.01); *E05F 3/22* (2013.01); *E05Y 2800/244* (2013.01); *E05Y 2900/132* (2013.01); *Y10T 16/56* (2015.01); *Y10T 16/577* (2015.01); *Y10T 16/593* (2015.01)

(58) Field of Classification Search

CPC ..... E05F 3/22; E05F 3/227; E05F 1/1041; E05F 1/105; E05F 3/10; E05F 3/102; E05F 3/104; E05F 3/12; Y10T 16/276; Y10T 16/2766; Y10T 16/2769; Y10T 16/2777; Y10T 16/2788; Y10T 16/2804; Y10T 16/281; Y10T 16/285; Y10T 16/293; Y10T 16/56; Y10T 16/577; Y10T 16/593; Y10T 16/599; Y10T 16/5995

USPC ..... 16/71, 79, 72, 75, 76, 51, 52, 53, 56, 16/58, 62, 66, 69, 64

See application file for complete search history.

(56) References Cited

U.S. PATENT DOCUMENTS

| | | | | | |
|---|---|---|---|---|---|
| 3,188,682 | A | * | 6/1965 | Check et al. | 16/49 |
| 3,252,178 | A | * | 5/1966 | Check et al. | 16/49 |
| 4,075,734 | A | * | 2/1978 | Nagase | 16/58 |
| 4,086,681 | A | * | 5/1978 | Nakanishi | 16/49 |
| 4,231,134 | A | * | 11/1980 | Schoker | 16/49 |
| 4,831,687 | A | * | 5/1989 | Lin et al. | 16/49 |
| 4,847,946 | A | * | 7/1989 | Nam et al. | 16/53 |
| 5,187,835 | A | * | 2/1993 | Lee | 16/52 |
| 5,206,971 | A | * | 5/1993 | Schmelzer et al. | 16/62 |
| 5,511,287 | A | * | 4/1996 | Lautenschlager et al. | 16/239 |

(Continued)

FOREIGN PATENT DOCUMENTS

| | | | | |
|---|---|---|---|---|
| DE | 3344680 A1 | * | 6/1985 | E05F 3/10 |
| EP | 469697 A1 | * | 2/1992 | E05F 3/10 |

(Continued)

*Primary Examiner* — Jeffrey O Brien

(74) *Attorney, Agent, or Firm* — Cozen O'Connor

(57) ABSTRACT

A door operator includes a base plate with a receiving profile, a shaft housing inserted into the receiving profile, a first cylinder housing inserted into the receiving profile, a driven shaft rotatably bearing-mounted in the shaft housing, and a piston which is linearly movably guided in the first cylinder housing. The piston and the driven shaft cooperate for mutual conversion between a linear movement of the piston and a rotational movement of the driven shaft, and an energy accumulator is arranged in the first cylinder housing and cooperates with the piston.

8 Claims, 6 Drawing Sheets

(56) References Cited

U.S. PATENT DOCUMENTS

| | | | | |
|---|---|---|---|---|
| 6,032,330 | A * | 3/2000 | Chen | 16/71 |
| 6,125,505 | A * | 10/2000 | Jensen et al. | 16/71 |
| 6,205,615 | B1 * | 3/2001 | Jensen et al. | 16/71 |
| 6,298,520 | B1 * | 10/2001 | Blickhahn et al. | 16/71 |
| 6,363,575 | B1 * | 4/2002 | Kaser | 16/48.5 |
| 6,374,505 | B2 * | 4/2002 | Myers et al. | 33/566 |
| 6,421,876 | B1 * | 7/2002 | Ginzel et al. | 16/79 |
| 7,007,342 | B2 * | 3/2006 | Huang | 16/79 |
| 7,698,796 | B1 * | 4/2010 | Dowling et al. | 29/402.08 |
| 7,815,023 | B2 * | 10/2010 | Salutzki | 188/322.22 |
| 8,756,759 | B2 * | 6/2014 | Kaestle et al. | 16/71 |
| 8,773,237 | B2 * | 7/2014 | Burris et al. | 340/3.32 |
| 8,793,838 | B2 * | 8/2014 | McKibben et al. | 16/72 |
| 8,819,895 | B2 * | 9/2014 | Bienek | 16/53 |
| 8,826,494 | B2 * | 9/2014 | Bienek et al. | 16/53 |
| 2002/0007563 | A1 * | 1/2002 | Myers et al. | 33/566 |
| 2002/0066157 | A1 * | 6/2002 | Chen | 16/58 |
| 2003/0213092 | A1 * | 11/2003 | Fischbach et al. | 16/52 |
| 2004/0205931 | A1 * | 10/2004 | Huang | 16/79 |
| 2005/0246860 | A1 * | 11/2005 | Huang | 16/79 |
| 2007/0251051 | A1 * | 11/2007 | Miyashita | 16/79 |
| 2011/0191981 | A1 * | 8/2011 | Bell | 16/72 |
| 2013/0047514 | A1 * | 2/2013 | Kaestle et al. | 49/349 |
| 2013/0075558 | A1 * | 3/2013 | Houser et al. | 248/224.8 |
| 2013/0227815 | A1 * | 9/2013 | Wulbrandt | 16/71 |

FOREIGN PATENT DOCUMENTS

| | | | | |
|---|---|---|---|---|
| EP | 562465 | A1 * | 9/1993 | E05F 3/10 |
| GB | 2358888 | A * | 8/2001 | E05F 3/00 |

* cited by examiner

DOOR OPERATOR

BACKGROUND OF THE INVENTION

1. Field of the Invention

The present invention is directed to a door operator for moving a wing of a door.

2. Description of the Related Art

Different door operators are known from the prior art, particularly door closers, servo door closers and door drives. The door operators always have a driven shaft. The door operator itself can be fastened either to the door leaf or to a wall or frame. If the door operator is fastened directly to the door leaf, the force is transmitted from the driven shaft to the wall or frame via a linkage. If the door operator is fastened to the wall or frame, the linkage transmits the force from the driven shaft to the door leaf. Conventional door operators have a complicated cast housing. The driven shaft is bearing-mounted in this cast housing. Further, at least one piston is located in the cast housing and is acted upon by an energy accumulator spring. The piston cooperates with the driven shaft such that a mutual conversion takes place between a linear movement of the piston and a rotational movement of the driven shaft.

SUMMARY OF THE INVENTION

It is the object of the present invention to provide a reliably functioning door operator which is constructed in a simple manner and is inexpensive to produce and assemble.

This object is met by a door operator comprising a base plate with a receiving profile. A shaft housing and a first cylinder housing are inserted into the receiving profile of the base plate. The first cylinder housing and the shaft housing are positively connected to the base plate by means of the corresponding receiving profile. Assembly is particularly simple because the first cylinder housing and the shaft housing need only be inserted into the receiving profile in longitudinal direction of the base plate. Further, the door operator comprises a driven shaft which is rotatably bearing-mounted in the shaft housing and a piston which is linearly movably guided in the first cylinder housing. The piston and the driven shaft cooperate for mutual conversion between a linear movement of the piston and a rotating movement of the driven shaft. Further, an energy accumulator, particularly a compression spring, is arranged in the first cylinder housing. The energy accumulator cooperates with the piston. The door operator is formed in particular as a door closer: the driven shaft is set in rotation by manual actuation of the door wing. Accordingly, the piston moves linearly and compresses the energy accumulator. The energy accumulator is relaxed for closing the doors. Accordingly, the energy accumulator moves the piston linearly. The linear movement of the piston is converted into a rotational movement of the driven shaft. The driven shaft in turn acts on the door wing, for example, by means of a linkage.

In one aspect, a second cylinder housing is preferably provided. The second cylinder housing is also preferably inserted into the receiving profile of the base plate. The two cylinder housings are arranged on the two sides of the shaft housing so that the driven shaft is positioned between the two cylinder housings. The two cylinder housings are preferably connected to the shaft housing in a fluid-tight manner. Various possibilities are preferably provided for the connection between the shaft housing and the two cylinder housings: the connection can be carried out by screwing, soft soldering or hard soldering, welding, gluing, pinning, pressing or squeeze fitting. It is further possible to arrange ring seals on the housing components and to insert the components along with the ring seal one inside of the another. Further, the housing components can be clamped by means of clamping rings.

Two preferred variants are provided for the conversion between the linear movement of the piston and the rotational movement of the driven shaft: in the first variant, only a piston is used. This piston is guided into both cylinder housings. The piston has an inner toothed rack. The driven shaft extends through the piston. A toothed wheel is formed on the driven shaft. This toothed wheel engages with the toothed rack. In the second variant, a cam disk is arranged on the driven shaft so as to be fixed with respect to rotation relative to it. The piston contacts the cam disk, particularly by a pressure roller. In this second variant, in particular two pistons are provided, respectively, with a pressure roller. One of the pistons is linearly movably guided in each instance in a cylinder housing.

The receiving profile in the base plate preferably has at least one first positive connection element. This first positive connection element is preferably formed as a groove. The housing components, i.e., the first cylinder housing and/or the second cylinder housing and/or the shaft housing, each have at least one second positive connection element. This second positive connection element complements the first positive connection element and is formed, for example, as a projection. In particular, the housing components have two parallel projections which are inserted into the two grooves of the receiving profile.

The base plate preferably extends in a longitudinal direction. The complementary positive connection elements are formed in such a way that the housing components are movable only in longitudinal direction with respect to the base plate. Corresponding undercuts ensure that the housing components cannot be moved away from the base plate perpendicular to the longitudinal direction.

The base plate and/or the first cylinder housing and/or the second cylinder housing and/or the shaft housing are preferably formed as extruded parts. Extrusion is a deforming process for producing rods, wires, tubes and irregularly shaped prismatic profiles. In this method, a blank or material in hot or cold state is pressed through a die. The shape of the extrusion is determined by the die. Cavities can be formed by differently shaped mandrels. All metals and many plastics are suitable for extrusion. Extrusion is used primarily for aluminum and aluminum alloys, copper and copper alloys. Further, stainless steels, magnesium alloys, titanium alloys or solders can be extruded. When using plastic, the terms extrusion process and, correspondingly, extrusion components are used. The housing components can be produced inexpensively and in a simple manner through the use of extrusion components. In particular, the complementary positive connection elements can be fabricated easily in this way. There is a wide variety of possible shapes for the outer geometries of the housing components. The inner geometry of the cylinder housing and the outer geometry of the piston complementing the latter can be round, oval or polygonal.

Extrusion has the further advantage that it also allows profiles to be produced which have complicated shapes and which are made of materials which are difficult to deform. The high degree of deformability that can be achieved in one process step and the low tooling cost for manufacturing the door operator are particularly attractive for small quantities.

In accordance with a further aspect of the present invention, at least one hydraulic line is preferably formed in the base plate. In particular, the hydraulic line can be formed in the base plate as a continuous linear cavity by producing the base plate as extrusion component. The hydraulic line is preferably closed in a fluid-tight manner at the two ends of the base plate by means of closures. At least one first opening is preferably provided in the hydraulic line. At least one second opening is located in the first cylinder housing and/or in the second cylinder housing and/or in the shaft housing. By sliding the housing components onto the base plate, the first opening and the second opening are placed in alignment one above the other. This results in a hydraulic connection between an interior space of the housing component and the hydraulic line in the base plate. In a particularly preferred manner, a valve is arranged in the first opening. This valve is formed, for example, as a ball valve. This valve is opened when the corresponding housing components are slid on and the first opening and second opening overlap.

Two different variants are provided for fastening the base plate to a main structure, e.g., a door wing, a wall or a frame: in the first variant, at least one end cap is fitted laterally on the base plate. Mounting holes, for example, are provided in this end cap. The end cap and therefore also the base plate are screwed on using these mounting holes. In a second variant, a mounting plate is used. The mounting plate is used to screw to the main structure. A further receiving profile is formed in the mounting plate. The base plate is inserted into this further receiving profile. The mounting plate is also particularly preferably formed as an extrusion component.

The mounting plate and/or the base plate and/or the first cylinder housing and/or the second cylinder housing and/or the shaft housing can be made of metal or plastic.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention will now be described in more detail referring to embodiment examples. The drawings show.

DETAILED DESCRIPTION OF THE PRESENTLY PREFERRED EMBODIMENTS

Figure 3:
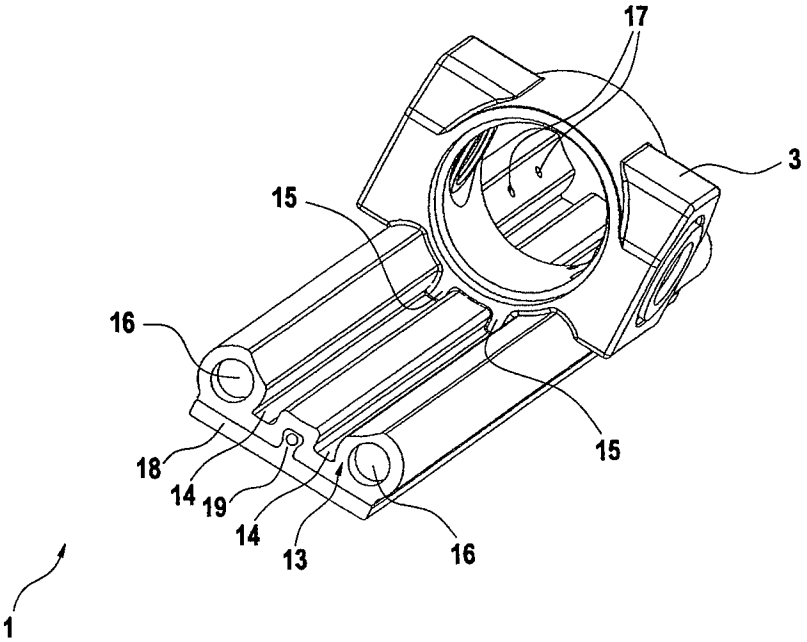
FIG. 3 a first detail of the door operator according to the first embodiment of the invention.
Figure 4:
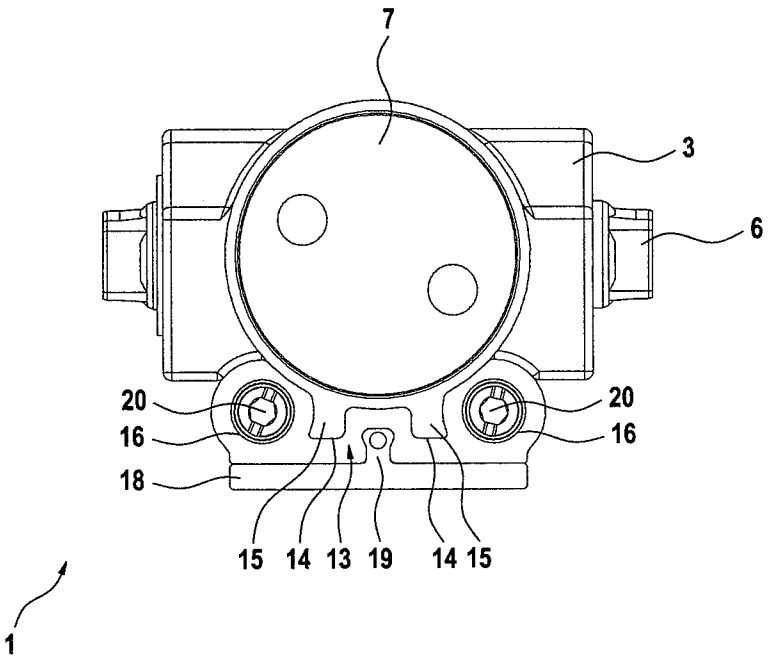
FIG. 4 a second detail of the door operator according to the first embodiment of the invention.
Figure 5:
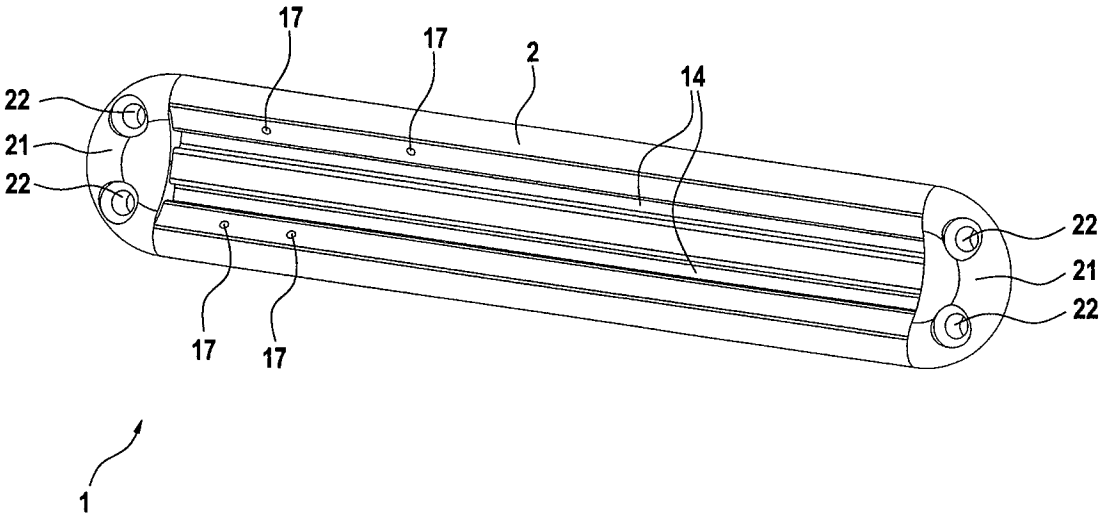
FIG. 5 a detail of a door operator according to the second embodiment of the invention.
Figure 6:
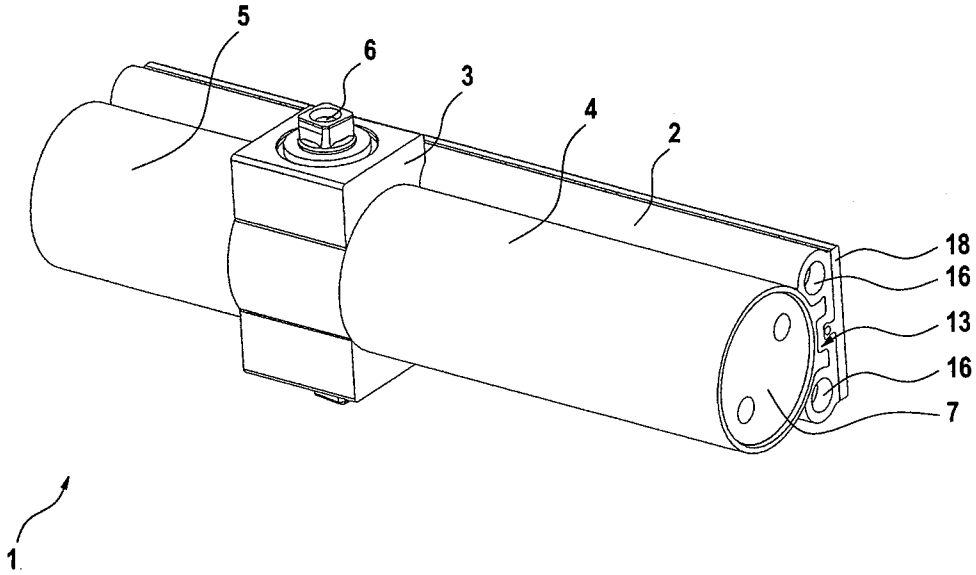
FIG. 6 an example of a door operator according to a third embodiment of the invention.

A first embodiment example of a door operator 1 is described in the following with reference to FIGS. 1 to 4. FIG. 5 shows a detail of a second embodiment example. FIG. 6 shows the door operator 1 in a third embodiment example. Structural component parts which are identical or which function identically are provided with the same reference numerals in all of the embodiment examples.

Figure 1:
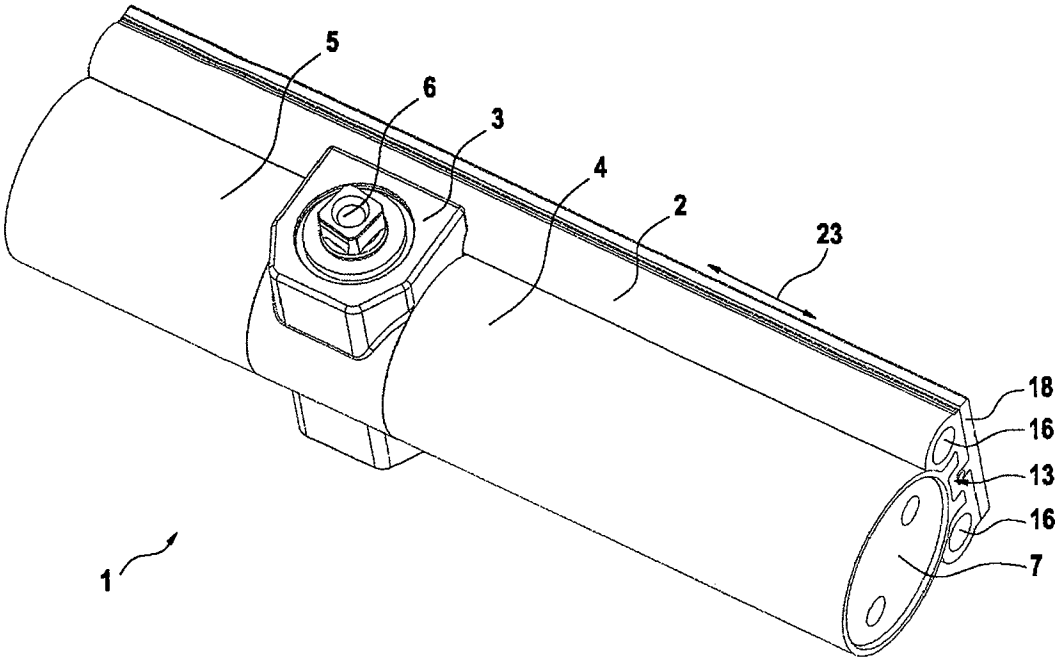
FIG. 1 an example of a door operator according to a first embodiment of the invention.

According to FIG. 1, the door operator 1, which is formed as a door closer, has a base plate 2. The base plate 2 extends in a longitudinal direction 23. A shaft housing 3, a first cylinder housing 4 and a second cylinder housing 5 are mounted on the base plate 2. A driven shaft 6 is rotatably bearing-mounted in the shaft housing 3. A linkage is mounted at the driven shaft 6, for example. If the door operator 1 is fastened to a wall or frame, this linkage transmits the force from the driven shaft 6 to the door wing. For reverse mounting, the door operator 1 is mounted on a door wing. The force is transmitted from the driven shaft 6 to the wall or frame via the linkage.

Figure 2:
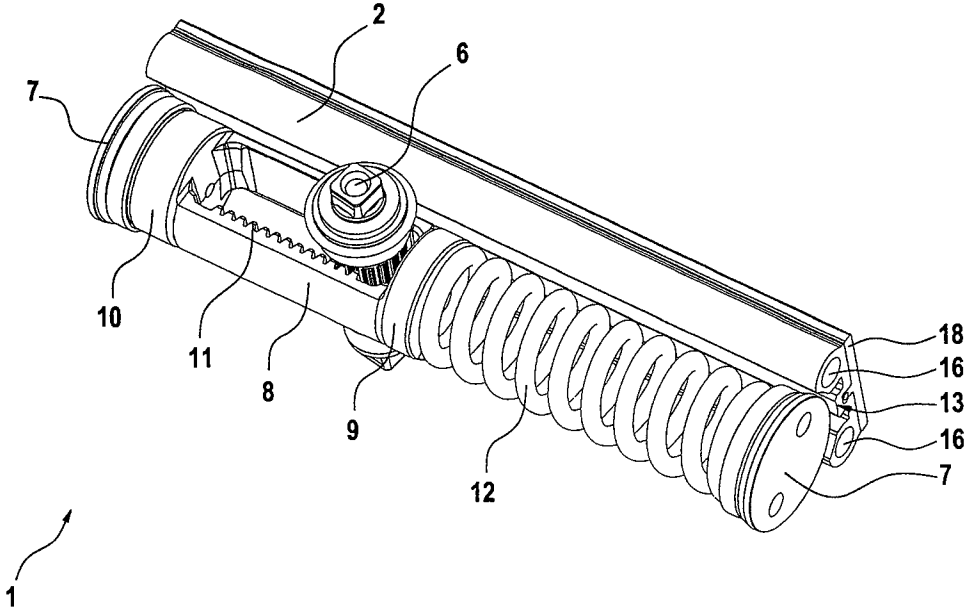
FIG. 2 the inner construction of the door operator according to the first embodiment of the invention.

For the sake of clarity, the first cylinder housing 4, the second cylinder housing 5 and the shaft housing 3 are omitted in FIG. 2. FIG. 3 shows only the base plate 2 with a mounting plate 18 and the shaft housing 3. FIG. 4 shows a detailed front view of the door operator 1.

The base plate 2, the first cylinder housing 4, the second cylinder housing 5 and the mounting plate 18 are formed in the depicted embodiment example as extrusion components. Accordingly, the two cylinder housings 4, 5 are tubular and are open at their ends. One end of the cylinder housings 4, 5 is connected in each instance to the shaft housing 3 in a fluid-tight manner. The outer ends of the cylinder housings 4, 5 are closed in a fluid-tight manner by covers 7.

As is shown in FIG. 2, the door operator 1 comprises a piston 8. The piston 8 is slotted. The driven shaft 6 projects through this slot. A toothed wheel is formed on the driven shaft 6. This toothed wheel engages with an inner toothed rack 11 of the piston 8. The mutual conversion between the linear movement of the piston 8 and the rotational movement of the driven shaft 6 takes place through this connection between the toothed wheel and toothed rack.

The piston 8 has a first guide surface 9 and a second guide surface 10 at two ends. The piston 8 is guided in the first cylinder housing 4 by the first guide surface 9. The piston 8 is guided in the second cylinder housing 5 by the second guide surface 10.

Further, an energy accumulator 12 formed as a compression spring is arranged in the first cylinder housing 4. The energy accumulator 12 is supported by one end against the piston 8 and by the other end against the cover 7 of the first cylinder housing 4.

FIG. 3 shows the connection between the housing components and the base plate 2 in detail. The base plate 2 has a receiving profile 13. This receiving profile 13 extends in longitudinal direction 23 along the entire length of the base plate 3. In the detailed view, the receiving profile 13 is formed by two parallel grooves 14.

The shaft housing 3, the first cylinder housing 4 and the second cylinder housing 5, respectively, have two parallel projections 15. These parallel projections 15 are inserted into the parallel grooves 14. Undercuts are formed to prevent a movement of the housing components away from the base plate 2 perpendicular to the longitudinal direction 23.

Further, two parallel hydraulic lines 16 are arranged in the base plate 2. The two hydraulic lines 16 run parallel to the grooves 14. First openings 17 are formed in the hydraulic lines 16. Second openings (not shown) are formed in the shaft housing 3, the first cylinder housing 4 and/or the second cylinder housing 5. The first openings and second openings are arranged so as to be aligned one above the other so as to ensure a connection between the hydraulic lines 16 and the interior of the housing. Alternatively, the first openings 17 can be drilled after assembling together with the second opening.

A gap between the first opening 17 and the second opening is preferably sealed. Sealing elements can be used for this purpose. Alternatively, a sealing compound is injected into the first opening and into the second opening. In so doing, the sealing compound also flows into the gap. After the sealing compound cures, drilling is carried out through the two aligned openings.

As is shown particularly in FIG. 4, the hydraulic lines 16 are closed at the ends of the base plate 2 by means of closures 20. Instead of closures 20, control valves and/or ball closures can be used at least in certain areas. In particular, control valves are used on one side.

A mounting plate 18 is provided for mounting the door operator 1 on a main structure, for example, a door wing, a wall or a frame. A further receiving profile 19 is formed in the mounting plate 18. The base plate 2 is fitted into or onto this further receiving profile 19 so as to bring about a fixed connection between mounting plate 18 and base plate 2.

FIG. 5 shows a detail of the door operator 1 according to the second embodiment. No mounting plate 18 is used in the second embodiment. Instead, two end caps 21 are fitted to the ends of the base plate 2. Mounting holes 22 are provided in these end caps 21. The base plate 2 can be fastened directly to the main structure by the end caps 21.

FIG. 6 shows the door operator 1 according to the third embodiment example. The shaft housing 3 is also formed as an extrusion component in the third embodiment example.

Except for the differences mentioned above, the three embodiment examples are the same.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A door operator (1) comprising:

a base plate (2) having a receiving profile (13) comprising parallel grooves (14) arranged along a direction of longitudinal extent of the base plate;

a shaft housing (3) having shaft housing parallel projections inserted into the parallel grooves (14) of the receiving profile (13);

a first cylinder housing (4) having first cylinder parallel projections inserted into the parallel grooves (14) of the receiving profile (13);

a second cylinder housing (5) having second cylinder parallel projections inserted into the parallel grooves (14) of the receiving profile (13);

a driven shaft (6) rotatably bearing-mounted in the shaft housing (3), the driven shaft (6) having a toothed wheel formed thereon; and a piston (8) linearly movably guided in the first cylinder housing (4), the piston (8) having a slot through which the driven shaft (6) projects, the slot having an inner toothed rack (11) that engages the toothed wheel, wherein the piston (8) and the driven shaft (6) cooperate for mutual conversion between a linear movement of the piston (8) and a rotational movement of the driven shaft (6), the mutual conversion being effected by the engagement between the toothed wheel and the inner toothed rack (11), and an energy accumulator (12) is arranged in the first cylinder housing (4) and cooperates with the piston (8), and wherein the first cylinder housing (4) is connected along the direction of longitudinal extent of the base plate on a first side to the shaft housing (3), and wherein the second cylinder housing (5) is connected to the shaft housing (3) along the direction of longitudinal extent of the base plate on a second side of the shaft housing opposing the first side.

2. The door operator according to claim 1, wherein the first cylinder housing (4) and/or the second cylinder housing (5) are/is connected to the shaft housing (3) in a fluid-tight manner.

3. The door operator according to claim 1, wherein the parallel grooves (14) are formed such that the first cylinder housing (4) and/or the second cylinder housing (5) and/or the shaft housing (3) are/is movable with respect to the base plate (2) only in a longitudinal direction (23) of the base plate (2).

4. The door operator according to claim 1, wherein the base plate (2) and/or the first cylinder housing (4) and/or the second cylinder housing (5) and/or the shaft housing (3) are/is formed as extrusion components.

5. The door operator according to claim 1, wherein at least one hydraulic line (16) is formed in the base plate (2).

6. The door operator according to claim 5, wherein at least one first opening (17) is provided in the hydraulic line (16), wherein at least one second opening is provided in the first cylinder housing (4) and/or in the second cylinder housing (5) and/or in the shaft housing (3), and wherein the first opening (17) aligns with the second opening by inserting the first cylinder housing (4) and/or the second cylinder housing (5) and/or the shaft housing (3).

7. The door operator according to claim 1, further comprising at least one end cap (21) arranged laterally at the base plate (2), wherein the base plate (2) is configured to be mounted on a main structure by the end cap (21).

8. The door operator according to claim 1, further comprising a mounting plate (18) having a further receiving profile (19) and which is mountable on a main structure, wherein the base plate (2) is configured to be inserted into the further receiving profile (19).

* * * * *